US005688625A

United States Patent [19]

Bertrand

[11] Patent Number: 5,688,625

[45] Date of Patent: Nov. 18, 1997

[54] TONER COMPOSITIONS WITH DISPERSED WAX

[75] Inventor: Jacques C. Bertrand, Ontario, N.Y.

[73] Assignee: Xerox Corporation, Stamford, Conn.

[21] Appl. No.: 606,927

[22] Filed: Feb. 26, 1996

[51] Int. Cl.[6] ..... G03G 5/00

[52] U.S. Cl. ..... 430/137; 430/110

[58] Field of Search ..... 430/137, 110

[56] References Cited

U.S. PATENT DOCUMENTS

| | | | |
|---|---|---|---|
| 4,513,074 | 4/1985 | Nash et al. | 430/106.6 |
| 4,556,624 | 12/1985 | Gruber et al. | 430/110 |
| 4,996,127 | 2/1991 | Hasegawa et al. | 430/137 |
| 4,997,739 | 3/1991 | Tomono et al. | 430/110 |
| 5,368,972 | 11/1994 | Yamashita et al. | 430/137 |
| 5,482,812 | 1/1996 | Hopper et al. | 430/137 |

*Primary Examiner*—Mark Chapman
*Attorney, Agent, or Firm*—E. O. Palazzo

[57] ABSTRACT

A process for minimizing the amount of wax that escapes from a toner which comprises melt mixing toner resin and pigment, and injecting a water emulsified wax composition therein, and wherein the generated wax domain size range is from about 50 to about 1,500 nanometers.

21 Claims, No Drawings

TONER COMPOSITIONS WITH DISPERSED WAX

BACKGROUND OF THE INVENTION

The present invention is generally directed to toner compositions, and more specifically, to toner compositions containing waxes therein. In embodiments, the present invention is directed to processes for the direct injection of an emulsified wax during the extrusion preparation of a toner composition, especially a toner comprised of a polyester, and particularly a crosslinked polyester, reference U.S. Pat. Nos. 5,376,494 and 5,227,460, the disclosures of which are totally incorporated herein by reference. The toner compositions of the present invention, in embodiments, possess a wide fusing latitude, for example about 100° C., which is the temperature range between the minimum fixing temperature of, for example, from about 100° C. to about 170° C. required for fixing toner particles on paper, and the hot offset temperature, for example from about 180° C. to about 250° C., which is the temperature where molten toner adheres to the fuser roll. The toner compositions of the present invention also provide toner images with low surface energy and a low frictional coefficient, which properties enable the effective release of paper from the fuser roll and provide for a reduction in image smudging. Further, the developer compositions of the present invention possess stable electrical properties for extended time periods, and with these compositions, for example, there is no substantial change in the triboelectrical charging values. Also, with the toner compositions of the present invention, the wax, which enhances toner release from the fuser roll and increases fusing latitude, is retained therein and the loss of wax from the toner is eliminated or minimized; and moreover, the toner compositions of the present invention with stabilized wax domains are more easily processed by extrusion, and are more easily jetted which allows more rapid toner production and lower toner manufacturing costs. The toner and developer compositions of the present invention are useful in a number of known electrostatographic imaging and printing systems, especially those systems wherein a wax is present in the toner.

Fixing performance of a toner can be characterized as a function of temperature. The lowest temperature at which the toner adheres to the support medium is referred to as Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images resulting, for example, in blurred images. This undesirable phenomenon is referred to as offsetting. Between the COT and HOT of the toner is the Minimum Fix Temperature (MFT) which is the minimum temperature at which acceptable adhesion of the toner to the support medium occurs, that is, as determined by, for example, a creasing test. The difference between MFT and HOT is referred to as the Fusing Latitude.

The hot roll fixing system described above and a number of toners presently used therein exhibit several problems. First, the binder resins in the toners can require a relatively high temperature in order to be affixed to the support medium. This may result in high power consumption, low fixing speeds, and reduced life of the fuser roll and fuser roll bearings. Second, offsetting can be a problem. Moreover, toners containing vinyl type binder resins, such as styrene-acrylic resins, may have an additional problem which is known as vinyl offset. Vinyl offset occurs when a sheet of paper or transparency with a fixed toner image comes in contact for a period of time with a polyvinyl chloride (PVC) surface containing a plasticizer used in making the vinyl material flexible, such as for example in vinyl binder covers, and the fixed image adheres to the PVC surface. Also, wax present in the toner can escape therefrom as large wax domains, or free wax, that is wax that is not permanently incorporated in the toner, but rather can be located on the toner surface after jetting. Melt mixing of waxes, especially low molecular weight waxes with a $M_w$ of from about 1,000 to about 20,000, results in many instances in wax domains of a size of from about 2 to about 10 microns in average volume diameter, or from about 1 to about 6 microns when a wax compatibilizer is present in the toner, which sizes can be too large for toners with a size of 9 microns or less. Further, a problem with the melt mixing of wax in the toner resin resides in elongated wax particles and which particles spread in the process direction producing large fracture planes during the micronization step and causing the generation of toner fines and undesirable free wax particles. Additionally, melting the wax and compatibilizer during the dispersing step causes some of the wax and compatibilizer to be molecularly dispersed in the toner resin causing resin rheological properties, such as Tg and melt index, to adversely change. These and other problems are avoided or minimized with the present invention.

There is a need for a toner resin which has low fix temperature and high offset temperature (or wide fusing latitude), and superior vinyl offset property, and processes for the preparation of such a resin. Toners which operate at lower temperatures would reduce the power needed for operation and increase the life of the fuser roll and the high temperature fuser roll bearings. Additionally, such low melt toners (i.e., toners having a MFT lower than 200° C., preferably lower than 160° C.) would reduce the volatilization of release oil, such as silicon oil, which may occur during high temperature operation and which can cause problems when the volatilized oil condenses in other areas of the machine. In particular, toners with a wide fusing latitude and with good toner particle elasticity are needed. Toners with wide fusing latitude can provide flexibility in the amount of oil needed as release agent and can minimize copy quality deterioration related to the toner offsetting to the fuser roll. Also, with the present invention in embodiments the injection of the wax in the extruder has the advantage of eliminating the prior art separate flushing step.

Developer and toner compositions, and processes thereof, with certain waxes therein, which waxes can be selected as a component for the toners of the present invention, are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$ from about 200 to about 6,000) to improve hot offset. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines i3 to 43.

Described in U.S. Pat. No. 4,367,275 are methods of preventing offsetting of electrostatic images of the toner composition to the fuser roll, which toner subsequently offsets to supporting substrates, such as papers, wherein there are selected toner compositions containing specific external lubricants including various waxes, see column 5, lines 32 to 45. Also, U.S. Pat. Nos. 5,229,242, which illustrates toners with KRATON®, and 4,814,253 are of interest.

There are various problems observed with the inclusion of polyolefin or other waxes in toners. For example, when a polypropylene wax is included in toner to enhance the release of toner from a hot fuser roll, or to improve the lubrication of a fixed toner image, it has been observed that the wax does not disperse well in the toner resin. As a result, free wax particles are released during the pulverizing/jetting, or micronization step in, for example, a fluid energy mill and the pulverization rate is lower. The poor dispersion of wax in the toner resin and, therefore, the loss of wax will then impair the release function for which it was designed. Scratch marks, for example, on xerographic developed toner solid areas caused by stripper fingers were observed as a result of the poor release. Furthermore, the free wax remaining in the developer will build up on the detone roll present in the xerographic apparatus causing a hardware failure.

The aforementioned problems, and others can be eliminated, or minimized with the toner compositions and processes of the present invention in embodiments thereof. The release of wax particles is, for example, a result of poor wax dispersion during the toner mechanical blending step. The toner additives should be dispersed well in the primary toner resin for them to impart their specific functions to the toner and thus the developer. For some of the additives, such as waxes like polypropylene, VISCOL 550P™, a low molecular weight (about 7,000) polypropylene wax, that become a separate molten phase during melt mixing, the difference in viscosity between the wax and the resin can be orders of magnitude apart, thus causing difficulty in reducing the wax phase domain size. A more fundamental reason for poor dispersion is due to the inherent thermodynamic incompatibility between polymers. The Flory-Huggins interaction parameter between the resin and the wax is usually positive (repulsive) and large so that the interfacial energy remains very large in favor of phase separation into large domains to reduce interfacial area. Some degree of success has been obtained by mechanically blending the toner formulation in certain types of mixers, such as the known Banbury mixer, where the temperature of melt can be maintained at a low level and polymer viscosities are similar. However, it has been found difficult to generate an effective wax dispersion in compounding extruders where melt temperatures are typically higher. The inclusion of a compatibilizer of the present invention is designed to overcome the inherent incompatibility between different polymers, and, more specifically, between toner resin and wax, thus widening the processing temperature latitude and enabling the toner preparation in a large variety of equipment, for example an extruder. The improvement in thermodynamic compatibility will also provide for a more stable dispersion of secondary polymer phase, such as wax, in the host resin against gross phase separation over time. The use of commercially available dispersant like KRATON G-1726®or D-1118®, which contain triblock copolymers and high molecular weight components, does not assist the thermodynamic stability and does not act as rubbery regions in the toner bulk. The elastic regions tend to create ductile fracture points and thereby reduce the jetting rate, and therefore, contribute to increased cost of powder processing.

Toner can be fixed to a support medium, such as a sheet of paper or transparency, by different fixing methods. A fixing system which is very advantageous in heat transfer efficiency and is especially suited for high speed electrophotographic processes is hot roll fixing. In this method, the support medium carrying a toner image is transported between a heated fuser roll and a pressure roll, with the image face contacting the fuser roll. Upon contact with the heated fuser roll, the toner melts and adheres to the support medium forming a fixed image.

To lower the minimum fix temperature of the binder resin, in some instances the molecular weight of the resin may be lowered. Low molecular weight and amorphous polyester resins and epoxy resins have been used for low temperature fixing toners. For example, attempts to use polyester resins as a binder for toner are disclosed in U.S. Pat. No. 3,590,000 and U.S. Pat. No. 3,681,106. The minimum fixing temperature of polyester binder resins can be lower than that of other materials, such as styrene-acrylic and styrene-methacrylic resins. However, this may lead to a lowering of the hot offset temperature, and as a result, decreased offset resistance. In addition, the glass transition temperature of the resin may be decreased, which may cause the undesirable phenomenon of blocking of the toner during storage.

To prevent fuser roll offsetting and to increase fuser latitude of toners, various modifications have been made in toner composition. For example, waxes, such as low molecular weight polyethylene, polypropylene, etc., have been added to toners to increase the release properties as disclosed in U.S. Pat. No. 4,513,074, the entire disclosure of which is hereby totally incorporated herein by reference. However, to prevent offset sufficiently, considerable amounts of such materials may be required in some instances resulting in detrimental effects, such as the tendency to toner agglomeration, worsening of free flow properties and destabilization of charging properties.

Modification of binder resin structure, for example by branching or crosslinking, when using conventional polymerization reactions may also improve offset resistance. In U.S. Pat. No. 3,681,106, for example, a polyester resin was improved with respect to offset resistance by nonlinearly modifying the polymer backbone by mixing a trivalent or more polyol or polyacid with the monomer to generate branching during polycondensation. However, an increase in degree of branching may result in an elevation of the minimum fix temperature. Thus, any initial advantage of low temperature fix may be diminished.

Another method of improving offset resistance is to utilize crosslinked resin in the binder resin. For example, U.S. Pat.

No. 3,941,898 to discloses a toner in which a crosslinked vinyl type polymer is used as the binder resin. Similar disclosures for vinyl type resins are made in U.S. Pat. No. Re 31,072 (a reissue of U.S. Pat. No. 3,938,992) to Jadwin et al., U.S. Pat. No. 4,556,624 to Gruber et al., U.S. Pat. No. 4,604,338 to Gruber et al. and U.S. Pat. No. 4,824,750 to Mahalek et al.

While significant improvements can be obtained in offset resistance and entanglement resistance, a major drawback may ensue in that with crosslinked resins prepared by conventional polymerization (that is, crosslinking during polymerization using a crosslinking agent), there exist three types of polymer configurations; a linear and soluble portion called the linear portion, a portion comprising highly crosslinked gel particles which is not soluble in substantially any solvent, for example tetrahydrofuran, toluene and the like, and is called gel, and a crosslinked portion which is low in crosslinking density and therefore is soluble in some solvents, for example, tetrahydrofuran, toluene and the like, and is referred to as sol. The presence of highly crosslinked gel in the binder resin increases the hot offset temperature, but at the same time the low crosslink density portion or sol increases the minimum fix temperature. An increase in the amount of crosslinking in these types of resins results in an increase not only of the gel content, but also of the amount of sol or soluble crosslinked polymer with low degree of crosslinking in the mixture. This results in an elevation of the minimum fix temperature, and as a consequence, in a reduction or reduced increase of the fusing latitude. Also, a drawback of embodiments of crosslinked polymers prepared by conventional polymerization is that as the degree of crosslinking increases, the gel particles or very highly crosslinked insoluble polymer with high molecular weight grow larger. The large gel particles can be more difficult for pigment dispersion, and such particles can cause the wax to escape and lose its function and the formation of unpigmented toner particles during pulverization, and toner developability may thus be hindered. Also, compatibility with other binder resins may be relatively poor and toners containing vinyl polymers often show vinyl offset.

Crosslinked polyester binder resins prepared by conventional polycondensation reactions have been made for improving offset resistance, such as for example in U.S. Pat. No. 3,681,106. As with crosslinked vinyl resins, increased crosslinking as obtained in such conventional polycondensation reactions may cause the minimum fix temperature to increase. When crosslinking is carried out during polycondensation using tri- or polyfunctional monomers as crosslinking agents with the polycondensation monomers, the net effect is that apart from making highly crosslinked high molecular weight gel particles, which are not soluble in substantially any solvent, the molecular weight distribution of the soluble part widens due to the formation of sol or crosslinked polymer with a very low degree of crosslinking, which is soluble in some solvents. These intermediate high molecular weight species may result in an increase in the melt viscosity of the resin at low and high temperature, which can cause the minimum fix temperature to increase. Furthermore, gel particles formed in the polycondensation reaction, which is carried out using conventional polycondensation in a reactor with low shear mixing, can grow rapidly with increase in degree of crosslinking. As in the case of crosslinked vinyl polymers using conventional polymerization reactions, these large gel particles may be more difficult to disperse pigment in, resulting in unpigmented toner particles after pulverization, and thus hindering developability.

A number of specific advantages are associated with the invention of the present application in embodiments thereof as indicated herein, and including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by free wax particles; avoiding pulverizing rate reduction resulting from the poor wax dispersion; maintaining the intended concentration of wax in the toner to provide enhanced release of toner images from the fuser roll and the avoidance of the undesirable scratch marks caused by the stripper fingers required for paper management; wide process latitudes during the mechanical blending operation of the toner manufacturing process; and effective mechanical blending of toner can be accomplished in a number of devices, including an extruder.

U.S. Pat. No. 4,894,308 and U.S. Pat. No. 4,973,439, for example, disclose extrusion processes for preparing electrophotographic toner compositions in which pigment and charge control additives were dispersed into the binder resin in the extruder. However, in each of these patents, there is no suggestion of a chemical reaction occurring during extrusion. Also, extruded toners and polyesters are illustrated in the patents mentioned herein, reference U.S. Pat. Nos. 5,376,494 and 5,227,460.

SUMMARY OF THE INVENTION

The present invention in embodiments is directed to the direct injection of wax into a mixture of toner resin and and pigment. More specifically, in embodiments the present invention relates to a process for the preparation of toners with wax, which process comprises the direct injection of emulsified wax with a controlled particle size into an extruder and which injection is accomplished during the toner preparation process. Wax dispersions in water with average particle sizes of from about 0.1 to about 5 microns can be selected and these dispersions can be obtained from Petrolite Corporation. Usually these dispersions contain a major amount of water, such as from about 55 to about 95 weight percent and a minor amount of wax, such as polypropylene, polyethylene, or mixtures thereof. Embodiments of the present invention include a process for minimizing the amount of wax that escapes from a toner, which comprises melt mixing toner resin and pigment, and injecting a water emulsified wax composition therein, and wherein the water emulsified wax contains from about 1 to 50 parts wax and from about 50 to 99 parts water, and further, wherein emulsion stabilizers, such as 4 parts morpholine, 4 parts nonylphenoxypolyethoxyethanol and 4 parts tall oil fatty acid, are present in the an amount of from 1 to 12 parts and which stabilizers are selected to primarily stabilize the dispersion of the wax in the water phase of the emulsion, and wherein the generated wax domain size range is from about 50 to about 1,500 nanometers. Embodiments of the present invention include a process for minimizing the amount of wax that escapes from a toner, which comprises melt mixing toner resin and pigment, and injecting a water emulsified wax composition therein and wherein the generated wax domain size range is from about 50 to about 1,500 nanometers, and in embodiments from about 100 to about 800 nanometers; a process wherein the melt mixing is accomplished in an extruder and the water emulsified wax is directly injected into the toner resin and pigment mixture subsequent to the injection of the resin and pigment; a process wherein the water emulsified wax contains from about 1 to 50 parts wax and from about 50 to 99 parts water, and further, wherein an emulsion stabilizer, such as 4 parts of morpholine, 4 parts of nonylphenoxypolyethoxyethanol and 4 parts of tall oil fatty acid, is selected in an amount of from 1 to 12 parts to stabilize the dispersion of the wax in the water phase of the emulsion; a process wherein the generated wax domain size range is from about 50 to about 200 nanometers; a process further including adding to the resin and pigment mixture a charge enhancing additive, for example selected from the group consisting of distearyl dimethyl ammonium methyl sulfate, cetyl pyridinium halide, and stearyl phenethyl dimethyl ammonium rosylate; and a process for the preparation of a toner composition which comprises the generation of said toner by melt extrusion of toner resin, pigment, and charge additive; feeding the resulting components into a toner extruder; injecting into the resin, pigment and charge additive melt stream via liquid injection an emulsified wax/water/stabilizer solution subsequent to the melting of the resin, pigment and charge additive components; and removing water by vacuum extraction during the extrusion.

The process of the present in embodiments comprises the following.

In a Werner & Pfleiderer ZSK-53 twin screw extruder, toner is prepared as follows: barrel temperature profile of 105°/110°/110°/115°/115°/115°/120° C., die head temperature of 140° C., screw speed of 250 revolutions per minute and average residence time of about three minutes with the processing rate of 30 pounds per hour. A mixture of 95 percent of thermoplastic resin and 5 percent of pigment were fed into zone #1 of the extruder. A Pulsafeeder 7120 pump was used to feed an injection nozzle in the #3 zone of the extruder. A solution comprised of 40 weight/volume percent of polyethylene wax/water and stabilizer emulsion was used. A pumping rate of 23 milliliters/minute was used. A vacuum extraction was done in zone #6 of the extruder to remove the water from the toner melt matrix. A toner matrix resulted that contained 4 weight percent of polyethylene wax. The toner was micronized using conventional air jet mill and classifiers. The resulting toner had a size of 9 microns. By a gravimetric analysis procedure, 0 percent of free wax was measured for this toner. Analysis by transmission electron microscopy indicated that the internal wax domains in the toner had sphere equivalent diameters of 150 nanometers with the maximum size being about or approximately 500 nanometers.

The toner resin is preferably a partially crosslinked unsaturated resin, such as unsaturated polyester prepared by crosslinking a linear unsaturated resin (base resin), such as linear unsaturated polyester resin, preferably with a chemical initiator in a melt mixing device such as, for example, an extruder at high temperature (for example, above the melting temperature of the resin and preferably up to about 150° C. above that melting temperature) and under high shear. In preferred embodiments, the base resin has a degree of unsaturation of about 0.1 to about 30 mole percent, preferably about 5 to about 25 mole percent. The shear levels should be sufficient to inhibit microgel growth above about 0.1 micron average particle diameter and to ensure substantially uniform distribution of the microgel particles. These shear levels are readily available in melt mixing devices such as extruders. This toner resin possesses, for example, a weight fraction of the microgel (gel content) in the resin mixture in the range typically from about 0.001 to about 50 weight percent, preferably about 0.1 to about 40 or 10 to 19 weight percent. The linear portion is comprised of base resin, preferably unsaturated polyester, in the range of from about 50 to about 99.999 percent by weight of said toner resin, and preferably in the range of from about 60 to about 99.9 or 81 to 90 percent by weight of said toner resin. The linear portion of the resin preferably consists essentially of a low molecular weight reactive base resin, which did not crosslink during the crosslinking reaction, such as preferably an unsaturated polyester resin. The number-average molecular weight ($M_n$) of the linear portion as measured by gel permeation chromatography (GPC) is in the range typically of from about 1,000 to about 20,000, and preferably from about 2,000 to about 5,000. The weight-average molecular weight ($M_w$) of the linear potion is in the range typically of from about 2,000 to about 40,000, and preferably from about 4,000 to about 15,000. The molecular weight distribution ($M_w/M_n$) of the linear portion is in the range typically of from about 1.5 to about 6, and preferably from about 2 to about 4. The onset glass transition temperature ($T_g$) of the linear portion as measured by differential scanning calorimetry (DSC) for preferred embodiments is in the range typically of from about 50° C. to about 70° C., and preferably from about 51° C. to about 60° C. Melt viscosity of the linear portion of preferred embodiments as measured with a mechanical spectrometer at 10 radians per second is from about 5,000 to about 200,000 poise, and preferably from about 20,000 to about 100,000 poise, at 100° C. and drops sharply with increasing temperature to from about 100 to about 5,000 poise, and preferably from about 400 to about 2,000 poise, as temperature rises from 100° C. to 130° C. This toner resin in embodiments thus contains a mixture of crosslinked resin microgel particles and a linear portion as illustrated herein. In embodiments of the toner resin of the invention, the onset $T_g$ is in the range typically from about 50° C. to about 70° C., and preferably from about 51° C. to about 60° C., and the melt viscosity as measured with a mechanical spectrometer at 10 radians per second is from about 5,000 to about 200,000 poise, and preferably from about 20,000 to about 100,000 poise at 100° C., and from about 10 to about 20,000 poise at 160° C. The low fix temperature of the toner resin of this invention is a function of the molecular weight and molecular weight distribution of the linear portion, and is not substantially affected by the amount of microgel particles or degree of crosslinking. This is portrayed by the proximity of the viscosity curves at low temperature (such as, for example, at 100° C.) in which the melt viscosity is in the range of from about 20,000 to about 100,000 poise as measured with a mechanical spectrometer at 10 radians per second. The hot offset temperature is increased with the presence of microgel particles which impart elasticity to the resin. With a higher degree of crosslinking or microgel content, the hot offset temperature increases. This is reflected in divergence of the viscosity curves at high temperature (such as, for example, at 160° C.) in which the melt viscosity is typically in the range of from about 10 to about 20,000 poise as measured at 10 radians per second depending on the amount of microgel particles in the resin. As the degree of crosslinking or microgel content increases, the low temperature melt viscosity does not change appreciably, while the high temperature melt viscosity goes up. In an exemplary embodiment, the hot offset temperature can increase approximately 30 percent. This can be achieved by crosslinking in the melt state at high temperature and high shear such as, for example, by crosslinking an unsaturated polyester using a chemical initiator in an extruder resulting in the formation of microgel alone, distributed substantially uniformly throughout the linear portion, and substantially no intermediates or sol portions which are crosslinked polymers with low crosslinking density. When crosslinked intermediate polymers are generated by conventional polymerization processes, the viscosity curves generally shift in parallel from low to high degree of crosslinking. This is reflected in increased hot offset temperature, but also increased the minimum fix temperature.

Linear unsaturated polyesters selected as the base resin are low molecular weight condensation polymers which may be formed by the step-wise reactions between both saturated and unsaturated diacids (or anhydrides) and dihydric alcohols (glycols or diols). The resulting unsaturated polyesters are reactive (e.g., crosslinkable) on two fronts: (i) unsaturation sites (double bonds) along the polyester chain, and (ii) functional groups, such as carboxyl, hydroxy, etc. groups, amenable to acid-base reactions. Typical unsaturated polyester base resins useful for this invention are prepared by melt polycondensation or other polymerization processes using diacids and/or anhydrides and diols. Suitable diacids and dianhydrides include, but are not limited to, saturated diacids and/or anhydrides, such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides, such as for example maleic acid, fumaric acid, chloromaleic acid, methacrylic acid, acrylic acid, iraconic acid, citraconic acid, mesaconic acid, maleic anhydride, and the like, and mixtures thereof. Suitable diols include, but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in good solvents such as, for example, tetrahydrofuran, toluene, and the like. Preferred unsaturated polyester base resins are prepared from diacids and/or anhydrides such as, for example, maleic anhydride, fumaric acid, and the like, and mixtures thereof, and diols such as, for example, proxylated bisphenol A, propylene glycol, and the like, and mixtures thereof. A particularly preferred polyester is poly(propoxylated bisphenol A fumarate).

Substantially any suitable unsaturated polyester can be used to prepare the toner resins of the invention, including unsaturated polyesters known for use in toner resins and including unsaturated polyesters whose properties previously made them undesirable or unsuitable for use as toner resins (but which adverse properties are eliminated or reduced by preparing them in the partially crosslinked form).

Chemical initiators, such as, for example, organic peroxides or azo-compounds, are preferred for making the crosslinked toner resins of the invention. Suitable organic peroxides include diacyl peroxides such as, for example, decanoyl peroxide, lauroyl peroxide and benzoyl peroxide; ketone peroxides such as, for example, cyclohexanone peroxide and methyl ethyl ketone; alkyl peroxyesters such as, for example, t-butyl peroxy neodecanoate, 2,5-dimethyl 2,5-di(2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy) hexane, oo-t-butyl o-(2-ethyl hexyl) mono peroxy carbonate, and oo4-amyl o-(2-ethyl hexyl) mono peroxy carbonate; alkyl peroxides such as, for example, dicumyl peroxide, 2,5-dimethyl 2,5-di(t-butyl peroxy) hexane, t-butyl cumyl peroxide, α-α-bis(t-butyl peroxy) diisopropyl benzene, di-t-butyl peroxide and 2,5-dimethyl 2,5-di(t-butyl peroxy) hexyne-3; alkyl hydroperoxides such as, for example, 2,5-dihydro peroxy 2,5-dimethyl hexane, cumene hydroperoxide, t-butyl hydroperoxide and t-amyl hydroperoxide; and alkyl peroxyketals such as, for example, n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy) cyclohexane, 2,2-di(t-butyl peroxy) butane, ethyl 3,3-di(t-butyl peroxy) butyrate and ethyl 3,3-di(t-amyl peroxy) butyrate. Suitable azo-compounds include azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), and other similar known compounds.

The low melt toners and toner resins may be prepared by a reactive melt mixing process wherein reactive resins are partially crosslinked, and wherein the wax dispersion is directly injected into the toner extrusion device selected. For example, low melt toner resins and toners may be fabricated by a reactive melt mixing process comprising the steps of: (1) melting reactive base resin, thereby forming a polymer melt in a melt mixing device; (2) initiating crosslinking of the polymer melt, preferably with a chemical crosslinking initiator and increased reaction temperature; (3) keeping the polymer melt in the melt mixing device for a sufficient residence time that partial crosslinking of the base resin may be achieved; (4) providing sufficiently high shear during the crosslinking reaction to keep the gel particles formed during crosslinking small in size and well distributed in the polymer melt; (5) optionally devolatilizing the polymer melt to remove any effluent volatiles. The high temperature reactive melt mixing process allows for very fast crosslinking which enables the production of substantially only microgel particles, and the high shear of the process prevents undue growth of the microgels and enables the microgel particles to be uniformly distributed in the resin. The wet cake of the wax can be introduced into the toner by flushing as illustrated herein.

A reactive melt mixing process can be considered a process wherein chemical reactions can be carried out on the polymer in the melt phase in a melt mixing device, such as an extruder. These reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. It is also advantageous because it permits a high degree of initial mixing of resin and initiator to take place, and provides an environment wherein a controlled high temperature (adjustable along the length of the extruder) is available so that a very quick reaction can occur. It also enables a reaction to take place continuously, and thus the reaction is not limited by the disadvantages of a batch process, wherein the reaction must be repeatedly stopped so that the reaction products may be removed and the apparatus cleaned and prepared for another similar reaction. As soon as the amount of crosslinking desired is achieved, the reaction products can be quickly removed from the reaction chamber.

The resins, such as the polyesters illustrated herein, styrene acrylates, styrene methacrylates, styrene butadienes, and the like, and preferably reactive extruded polyesters, are generally present in the toner of the invention in an amount of from about 40 to about 95 percent by weight, and more preferably from about 70 to about 92 percent by weight, although they may be present in greater or lesser amounts, provided that the objectives of the invention are achieved. For example, toner resins of the invention can be subsequently melt blended or otherwise mixed with a colorant, charge carrier additives, surfactants, emulsifiers, pigment dispersant, flow additives, and the like. The resultant product can then be pulverized by known methods, such as milling, to form toner particles. The toner particles preferably have an average volume particle diameter of about 5 to about 25, more preferably about 5 to about 15 microns.

Various suitable colorants can be employed in toners of the invention, including suitable colored pigments, dyes, and mixtures thereof including carbon black, such as REGAL 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, LITHOL SCARLET™, HOSTAPERM RED™, FANAL PINK™, Hostaperm Pink, Lithol Red, Rhodamine Lake B, Brilliant Carmine, Heliogen Blue, Hostaperm Blue, NEOPAN BLUE™, PV FAST BLUE™, Cinquassi Green, Hostaperm Green, titanium dioxide, cobalt, nickel, iron powder, Sicopur 4068 FF, and iron oxides, such as MAPICO BLACK® (Columbia), NP608 and NP604 (Northern Pigment), Bayferrox 8610 (Bayer), MO8699 (Mobay), TMB-100 (Magnox), mixtures thereof, and the like.

The colorant, preferably carbon black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 7 percent by weight for color toner and about 5 to about 60 percent by weight for blacktoner.

Various known suitable effective positive or negative charge enhancing additives can be selected for incorporation into the toner compositions of the present invention, preferably in an amount of about 0.1 to about 10, more preferably about 1 to about 3 percent by weight. Examples include quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, U.S. Pat. No. 4,338,390, the disclosure of which is totally incorporated hereby by reference; cetyl pyridinium tetrafluoroborates; distearyl dimethyl ammonium methyl sulfate; aluminum salts, such as BONTRON E84™ or E88™ (Hodogaya Chemical); and the like.

Examples of low molecular weight, for example from about 1,000 to about 20,000, and preferably from about 1,000 to about 7,000, waxes include those as illustrated in British Patent Publication 1,442,835, such as polyethylene, polypropylene, and the like, especially VISCOL 550P™ and VISCOL 660P™. The aforementioned waxes, which can be obtained in many instances from Sanyo Chemicals of Japan, are present in the wax dispersion, or wet cake and in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax, which can remain with the toner, will build up on the internal parts of the xerographic cleaning device causing a machine failure.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles, which are positively charged, will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, other known coatings, and the like.

The diameter of the carrier particles is generally from about 50 microns to about 1,000 microns, preferably from about 70 to about 200 microns, thus allowing these particles to possess sufficient density and inertia to avoid adherence to the electrostatic images during the development process. The carrier particles can be mixed with the toner particles in various suitable combinations. However, best results are obtained when about 1 part carrier to about 10 parts to about 200 parts by weight of toner are mixed.

The toners obtained with the processes of the present invention can be used in known electrostatographic imaging methods. Thus for example, the toners or developers of the invention can be charged, e.g., triboelectrically, and applied to an oppositely charged latent image on an imaging member such as a photoreceptor, especially a layered photoconductive imaging member, reference U.S. Pat. No. 4,265,990, the disclosure of which is totally incorporated herein by reference, or ionographic receivers. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 160° C., more preferably lower than 140° C., and more preferably about 110° C.

The invention will further be illustrated in the following, nonlimiting Examples, it being understood that these Examples are intended to be illustrative only and that the invention is not intended to be limited to the materials, conditions, process parameters, and the like recited herein. Parts and percentages are by weight unless otherwise indicated.

EXAMPLE I

A crosslinked unsaturated polyester resin is prepared by the reactive extrusion process by melt mixing 99.3 parts of a linear unsaturated polyester with the following structure

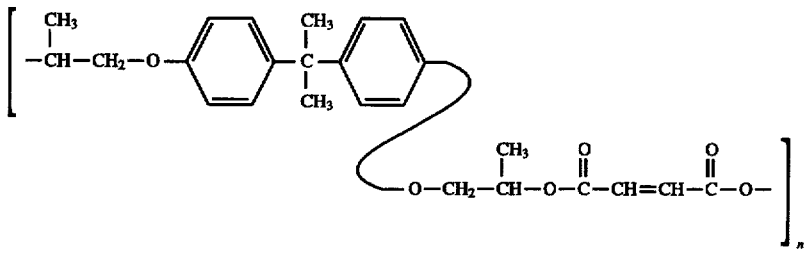

wherein n is the number of repeating units and having $M_n$ of about 4,000, $M_w$ of about 10,300, $M_w/M_n$ of about 2.58 as measured by GPC, onset $T_g$ of about 55° C. as measured by DSC, and melt viscosity of about 29,000 poise at 100° C. and about 750 poise at 130° C. as measured at 10 radians per second, and 0.7 part benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking is carried out in the extruder using the following process conditions: barrel temperature profile of 70°/140°/140°/140°/140°/140°/140° C., die head temperature of 140° C., screw speed of 100 revolutions per minute, and average residence time of about three minutes. The extrudate melt, upon exiting from the strand die, is cooled in a water bath and pelletized. The product, which is crosslinked polyester, has an onset $T_g$ of about 54° C. as measured by DSC, melt viscosity of about 40,000 poise at 100° C. and about 150 poise at 160° C. as measured at 10 radians per second, a gel content of about 0.7 weight percent, and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 3,900, $M_w$ of about 10,100, $M_w/M_n$ of about 2.59, and onset $T_g$ of 55° C. which is substantially the same as the original noncrosslinked resin, which indicates that it contains no sol.

Thereafter, a toner is formulated by melt mixing the above prepared crosslinked unsaturated polyester resin, 89 percent by weight, with 6 percent by weight of carbon blade, 4 percent of polyethylene wax (P3000 from Petrolire Corporation) with a $M_w$ of about 3,000, and 1 percent by weight of alkyl pyridinium halide charge enhancing additive are blended in a tumbler and then are fed into zone #1 of the extruder. A Werner & Pfleiderer ZSK-53 twin screw extruder using the following process conditions: barrel temperature profile of 105°/110°/110°/115°/115°/115°/120° C., die head temperature of 140° C., screw speed of 250 revolutions per minute and average residence time of about three minutes, with the processing rate of 30 pounds per hour. The toner is pulverized and classified to form a toner with an average particle diameter of about 9.0 microns and a geometric size distribution (GSD) of about 1.30. Wax escapes when the toner is selected to develop images in a Xerox Corporation 5090 test fixture as evidenced by gravimetric analysis procedure; 1 percent of the toner weight or 25 percent of the wax is lost. Further, the wax domain size is sphere equivalent diameter of 1,700 to 10,000 nanometers as determined by transmission electron microscopy and electronic image analysis.

EXAMPLE II

A crosslinked unsaturated polyester resin is prepared by the reactive extrusion process by melt mixing 96.9 parts by weight of a linear unsaturated polyester with the structure and properties described in Example I, and 1.1 parts by weight benzoyl peroxide initiator as outlined in the following procedure. A wax dispersion is then subsequently injected into the toner and during the mixing of the prepared polyester resin and REGAL 330® carbon black pigment in the extruder.

The unsaturated polyester resin and benzoyl peroxide initiator are blended in a rotary tumble blender for 30 minutes. The resulting dry mixture is then fed into a Werner & Pfleiderer twin screw extruder at 10 pounds per hour using a loss-in-weight feeder. The crosslinking is carried out in the extruder using the following process conditions: barrel temperature profile of 70°/140°/140°/140°/140°/140°/140° C., die head temperature of 140° C., screw rotational speed of 100 revolutions per minute and average residence time of about three minutes. The extrudate melt, upon exiting from the strand die, is cooled in a water bath and pelletized. The resulting product, which is crosslinked polyester, has an onset $T_g$ of about 54° C. as measured by DSC, melt viscosity of about 45,000 poise at 100° C. and about 1,600 poise at 160° C. as measured at 10 radians per second, a gel content of about 13 weight percent and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC and DSC, is found to have $M_n$ of about 3,900, $M_w$ of about 10,100, $M_w/M_n$ of about 2.59, and onset $T_g$ of 55° C., which is substantially the same as the original noncrosslinked resin, which indicates that it contains substantially no sol.

Thereafter, a toner is formulated by melt mixing the above prepared crosslinked unsaturated polyester resin, 89 percent by weight, with 6 percent by weight of carbon black, 4 percent of polyethylene wax (Syntran 6150 polyethylene wax emulsion available from Interpolymer Corporation) with a $M_w$ of around 3,400 with a particle size sphere equivalent diameter of 25 to 150 nanometers, as determined by a Brookhaven BI-90 laser light scattering instrument, and 1 percent by weight of the alkyl pyridinium halide cetyl pyridinium chloride charge enhancing additive in a Werner & Pfleiderer ZSK-53 twin screw extruder using the following process conditions: barrel temperature profile of 105°/110°/110°/115°/115°/115°/120° C., die head temperature of 140° C., screw speed of 250 revolutions per minute and average residence time of about three minutes, with the processing rate of 30 pounds per hour. A mixture of 94 parts resin, 5 parts wax, and 1 part alkyl pyridinium halide cetyl pyridinium chloride charge enhancing additive pigment is fed into zone #1 of the extruder. A Pulsafeeder 7120 pump was used to feed an injection nozzle in the #3 zone of the extruder wherein the wax is directly injected into the aforementioned toner mixture. A solution comprised of 40 weight/volume percent of polyethylene wax/water is used. A pumping rate of 23 milliliters/minute is used. A vacuum extraction is done in zone #6 of the extruder to remove the water from the toner melt matrix. The resulting toner matrix contains 4 percent of polyethylene wax. The toner is pulverized and classified to form a toner with an average particle diameter of about 9.0 microns and a geometric size distribution (GSD) of about 1.29. The toner is evaluated for fixing in a Xerox Corporation 5090 copier, for blocking, and vinyl offset performance. Results show the minimum toner fix temperature is about 146° C., the toner hot offset temperature is about 191° C., and the toner fusing latitude is about 45° C. Also, the toner has excellent blocking performance (about 49° C. as measured by open cup blocking measurement) and shows no apparent vinyl offset. Also, no wax escapes when the toner is selected to develop images in a Xerox Corporation 5090 test fixture as evidenced by gravimetric analysis. Further, the wax domain size has a sphere equivalent diameter of 150 to 500 nanometers as determined by transmission electron microscopy and electronic image analysis. This indicates that by using injection a much finer wax domain size with a narrow size distribution can be achieved over previous dry blending and melt mixing procedures.

The invention of the present application relates in embodiment to a direct injection of water emulsified wax into a toner melt composition during extrusion, and a process for controlling the fine dispersion of wax into a toner resin via flushing and wherein known wax compatibilizers may be selected, or such compatibilizers may be avoided, and a process wherein the water emulsified wax contains from about 1 to 50 parts of wax and from about 50 to 99 parts of water, and further wherein an emulsion stabilizer system which consists of 4 parts of morpholine, 4 parts of nonylphenoxypolyethoxyethanol and 4 parts of tall oil fatty acid is selected. Another example of an emulsion stabilizer system would be 2 parts of tridecyloxypoly(ethyleneoxy) thanol, 2 parts of sodium lauryl sulfate and 0.2 part of potassium persulfate. Another example of an emulsion stabilizer system would be 2 parts of nonylphenoxypolyethoxyethanol, 2 parts of octylphenoxypolyethoxyethanol and 1 part of sodium nonylphenoxypolyethoxyethanol sulfate. Another example of an emulsion stabilizer system would be 1 part of nonlyphenoxpolyethoxyethanol, 1 part of sodium lauryl sulfate and 1 part of zinc oxide complex. Other emulsion formula systems can be used per J. C. Johnson, "Emulsifiers and Emulsifying Techniques 1979", *Chemical Technology Rev.* (125), 16 (1979). The emulsion stabilizer system is used from about 1 to 12 parts to stabilize the dispersion of the wax particles in the water phase of the emulsion.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A process for minimizing the amount of wax that escapes from a toner which consists essentially of melt mixing toner resin and pigment, and injecting a water emulsified wax composition therein, and wherein the generated wax domain size range is from about 50 to about 1,500 nanometers, and wherein said water emulsified wax is directly injected into said toner resin and pigment mixture subsequent to the injection of said resin and said pigment.

2. A process in accordance with claim 1 wherein the melt mixing is accomplished in an extruder.

3. A process in accordance with claim 1 wherein the water emulsified wax contains from about 1 to 50 parts of wax and from about 50 to 99 parts of water, and further wherein an emulsion stabilizer system comprised of 4 parts of morpholine, 4 parts of nonylphenoxypolyethoxyethanol and 4 parts of tall oil fatty acid is selected in an amount of from about 1 to about 12 parts, and wherein said emulsion stabilizer functions to stabilize the wax particles in the water phase of the emulsion.

4. A process in accordance with claim 3 wherein the generated wax domain size range is from about 50 to about 200 nanometers.

5. A process in accordance with claim 1 wherein the wax possesses a weight average molecular weight of from about 1,000 to about 20,000.

6. A process in accordance with claim 1 wherein the wax possesses a weight average molecular weight of from about 3,000 to about 10,000.

7. A process in accordance with claim 5 wherein the wax is a polypropylene.

8. A process in accordance with claim 5 wherein the wax is a polyethylene.

9. A process In accordance with claim 1 wherein the resin is a styrene acrylate, a styrene methacrylate, or a styrene butadiene.

10. A process in accordance with claim 1 wherein the resin is a polyester.

11. A process in accordance with claim 1 wherein the pigment is carbon black, magnetite, or mixtures thereof.

12. A process in accordance with claim 1 wherein the pigment is selected from the group consisting of magenta, cyan, yellow, and mixtures thereof.

13. A process in accordance with claim 1 wherein the wax is a polyolefin, or mixture of polyolefins.

14. A process in accordance with claim 1 further including adding to the resin and pigment mixture a charge enhancing additive selected from the group consisting of distearyl dimethyl ammonium methyl sulfate, cetyl pyridinium halide, and stearyl phenethyl dimethyl ammonium tosylate.

15. A process in accordance with claim 1 wherein the resin is a polyester comprised of linear portions and crosslinked portions, and wherein said crosslinked portions are comprised of high density crosslinked microgel particles.

16. A process in accordance with claim 15 wherein said microgel particles are present in an amount of from about 0.001 to about 50 percent by weight of said toner resin.

17. A process in accordance with claim 15 wherein said microgel particles are from about 0.1 to about 0.5 micron in average volume diameter and are substantially uniformly distributed in said resin.

18. A process in accordance with claim 15 wherein said linear portions have a number-average molecular weight ($M_n$) as measured by gel permeation chromatography in the range of from about 1,000 to about 20,000.

19. A process in accordance with claim 15 wherein there results a low fix temperature toner comprising pigment and toner resin consisting essentially of an uncrosslinked phase and highly crosslinked microgel particles.

20. A process for the preparation of a toner composition consisting essentially of the generation of said toner by melt extrusion of toner resin, colorant, and charge additive; feeding the resulting components into a toner extruder; injecting into the resin, pigment and charge additive melt stream via liquid injection an emulsified wax/water/stabilizer solution subsequent to the melting of the resin, pigment and charge additive components; and removing water by vacuum extraction during the extrusion.

21. A process in accordance with claim 20 wherein the colorant is a pigment.

* * * * *